US007987948B2

(12) United States Patent
Yoon

(10) Patent No.: US 7,987,948 B2
(45) Date of Patent: Aug. 2, 2011

(54) LENGTH ADJUSTABLE PASSENGER HANDLE ASSEMBLY FOR ELEVATOR

(76) Inventor: Il Shik Yoon, Seoul (KR)

( * ) Notice: Subject to any disclaimer, the term of this patent is extended or adjusted under 35 U.S.C. 154(b) by 921 days.

(21) Appl. No.: 11/587,828

(22) PCT Filed: Nov. 24, 2005

(86) PCT No.: PCT/KR2005/003977

§ 371 (c)(1),
(2), (4) Date: Nov. 23, 2007

(87) PCT Pub. No.: WO2006/075841

PCT Pub. Date: Jul. 20, 2006

(65) Prior Publication Data

US 2011/0132700 A1 Jun. 9, 2011

(30) Foreign Application Priority Data

Jan. 13, 2005 (KR) ..... 20-2005-0001030 U

(51) Int. Cl.
*B66B 7/00* (2006.01)

(52) U.S. Cl. ..... 187/414; 187/401

(58) Field of Classification Search ..... 187/277, 187/313, 336, 340, 400, 401, 414; 256/59, 256/69, 65.02, 65.04–65.09, 65.11, 65.16
See application file for complete search history.

(56) References Cited

U.S. PATENT DOCUMENTS

| | | | | | |
|---|---|---|---|---|---|
| 3,741,595 | A * | 6/1973 | Horgan, Jr. | ..... | 403/59 |
| 3,811,176 | A * | 5/1974 | Horgan, Jr. | ..... | 29/469 |
| 4,153,234 | A * | 5/1979 | Sherwood et al. | ..... | 256/69 |
| 4,602,766 | A * | 7/1986 | Naka et al. | ..... | 256/59 |
| 4,635,756 | A * | 1/1987 | Sherwood et al. | ..... | 187/401 |
| 4,646,490 | A * | 3/1987 | Naka et al. | ..... | 52/184 |
| 4,779,707 | A * | 10/1988 | Smith et al. | ..... | 187/401 |
| 6,565,069 | B2 * | 5/2003 | Morris | ..... | 256/73 |
| 2006/0065493 | A1 * | 3/2006 | Bostock | ..... | 187/406 |

FOREIGN PATENT DOCUMENTS

| | | | |
|---|---|---|---|
| JP | 02286586 | A * | 11/1990 |
| JP | 05246659 | A * | 9/1993 |
| JP | 06156911 | A * | 6/1994 |
| JP | 07097163 | A * | 4/1995 |
| JP | 2006117364 | A * | 5/2006 |
| JP | 2008184231 | A * | 8/2008 |
| JP | 2010018374 | A * | 1/2010 |

* cited by examiner

*Primary Examiner* — Jonathan Salata
(74) *Attorney, Agent, or Firm* — Lumen Patent Firm

(57) ABSTRACT

Disclosed herein is a distance adjustable passenger handle assembly for an elevator. The handle assembly comprises plural fixing members (120), and plural handle supports (140). Each fixing member (120) includes a horizontal wall (122) having an opening (124) formed at an intermediate portion thereof along the entire length thereof. The opening (124) has a width which prevents the head of the fastener (30) from passing therethrough. Each handle support (140) includes a vertical partition (144), and a horizontal wall (146). The vertical partition (144) defines a space (143) inside the handle support (140), and has a through hole (145). The horizontal wall (146) has an opening (147) corresponding to the opening (124). With the handle securely fixed the handle support, the handle support (140) is inserted to the fixing member (120), adjusted to a desired distance to the inner wall, and securely coupled to the fixing member (120).

4 Claims, 6 Drawing Sheets

[Fig. 1]
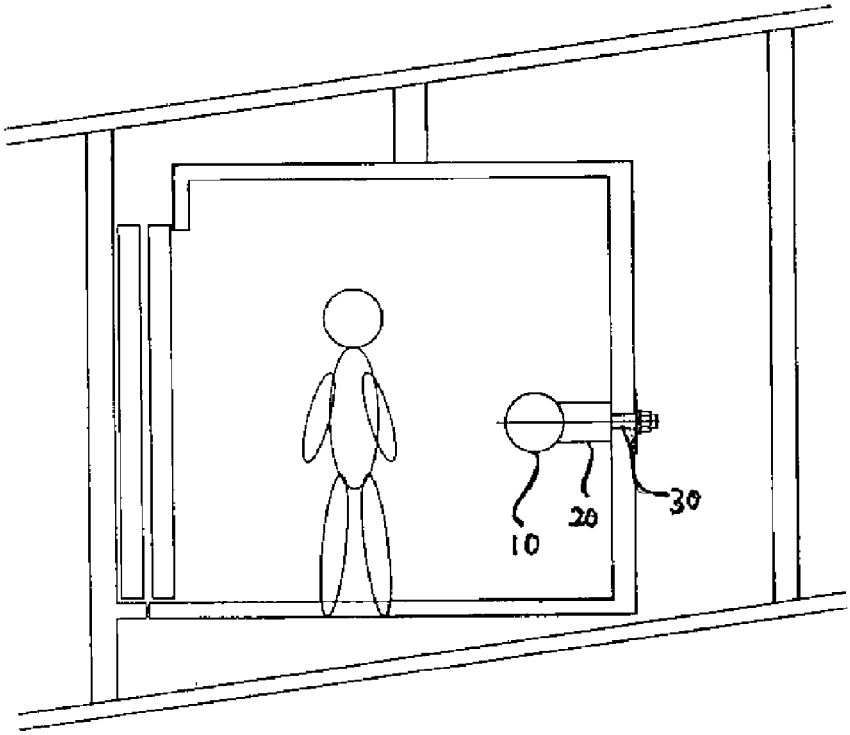
[Fig. 2]
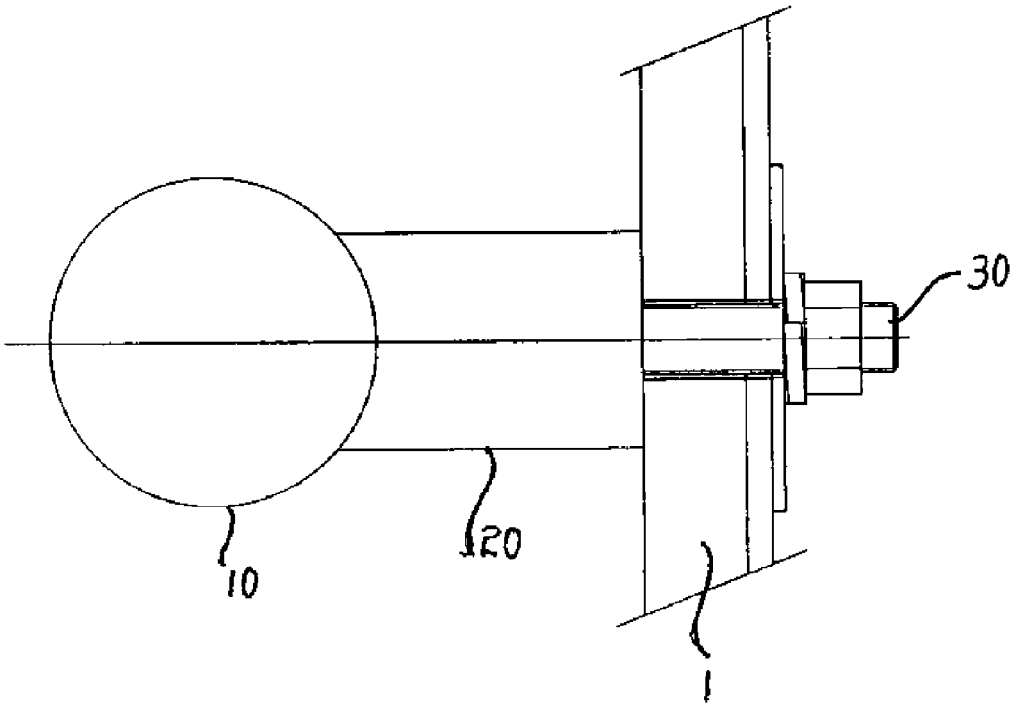

[Fig. 3]
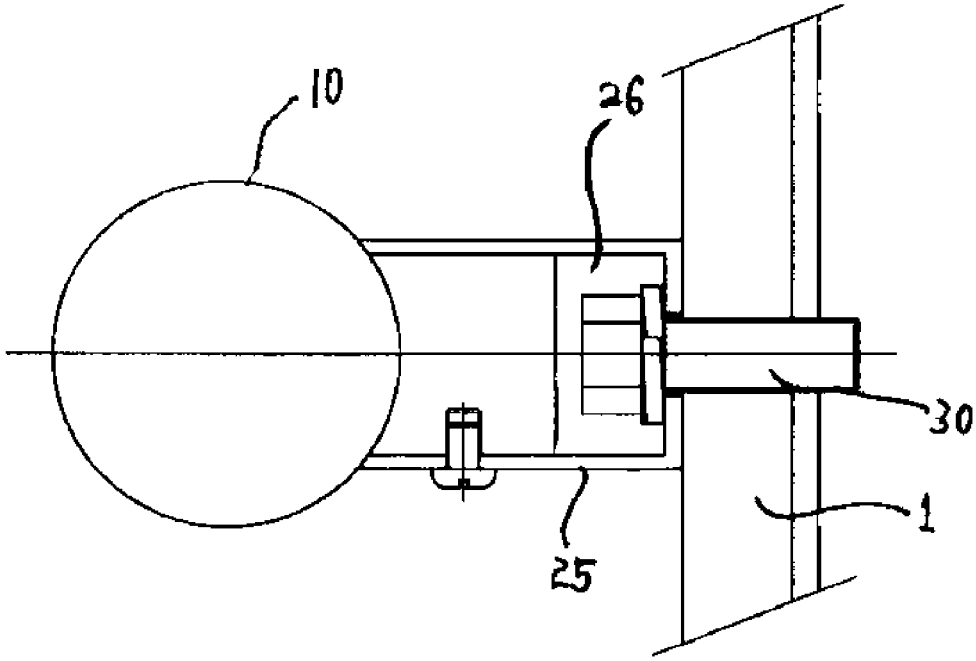
[Fig. 4]
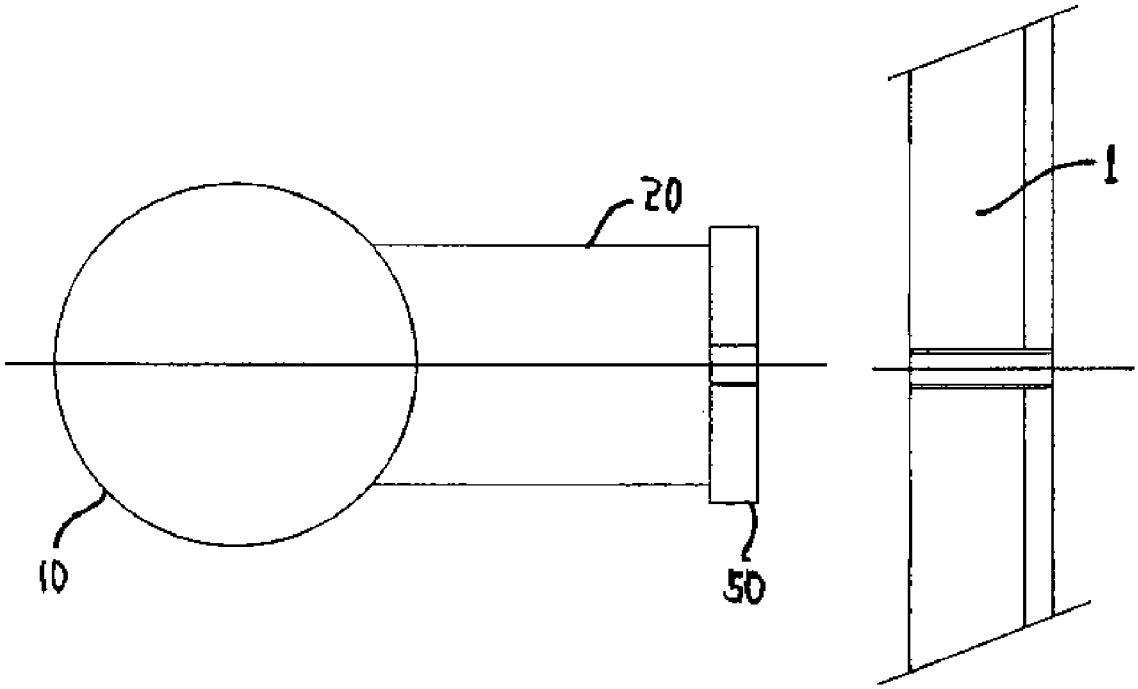

[Fig. 5]
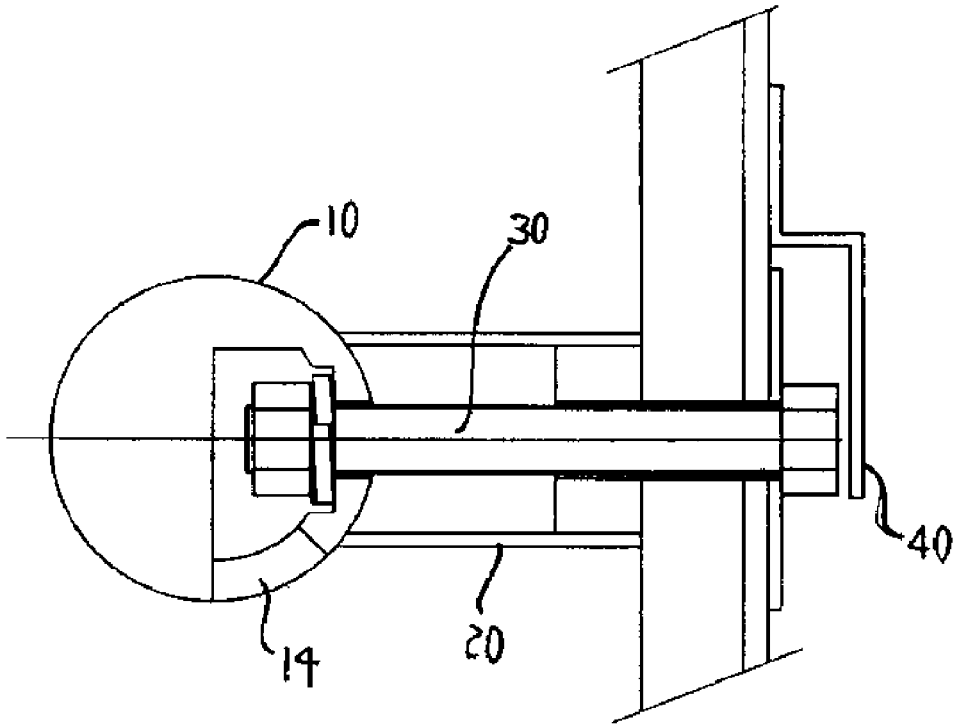
[Fig. 6]
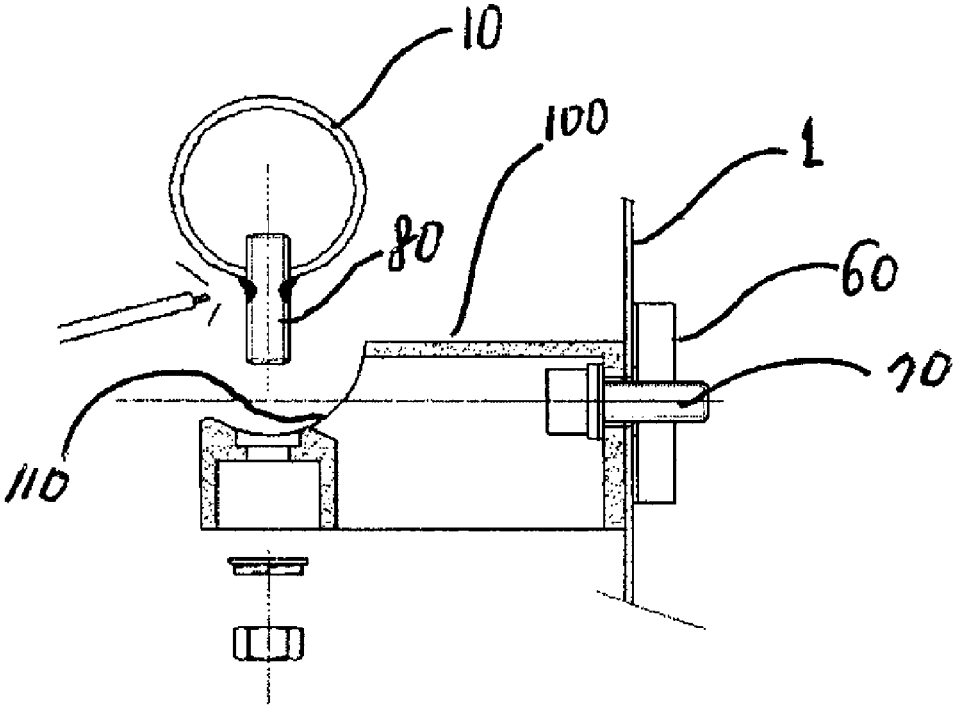

[Fig.7]
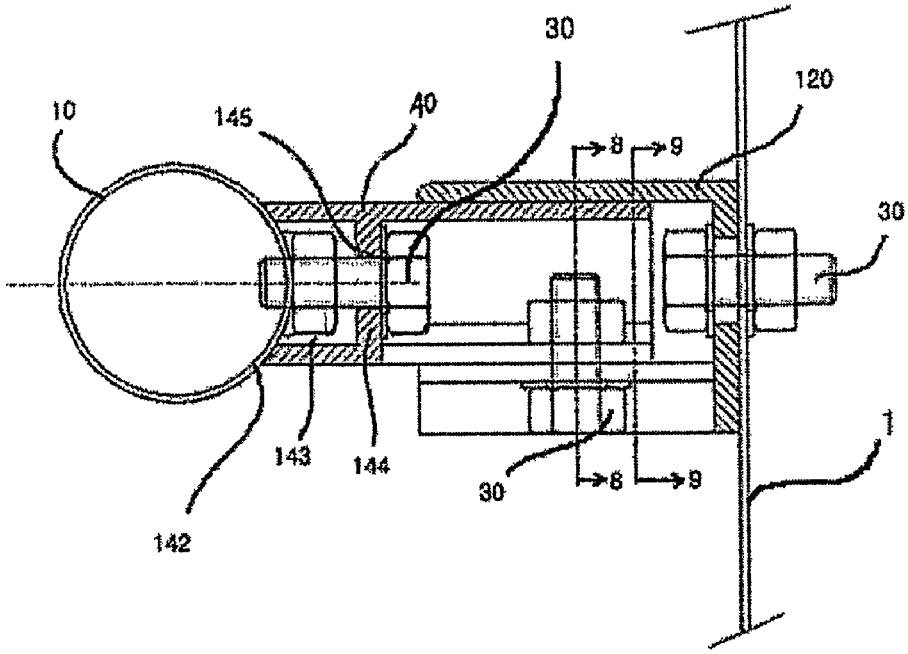
[Fig.8]
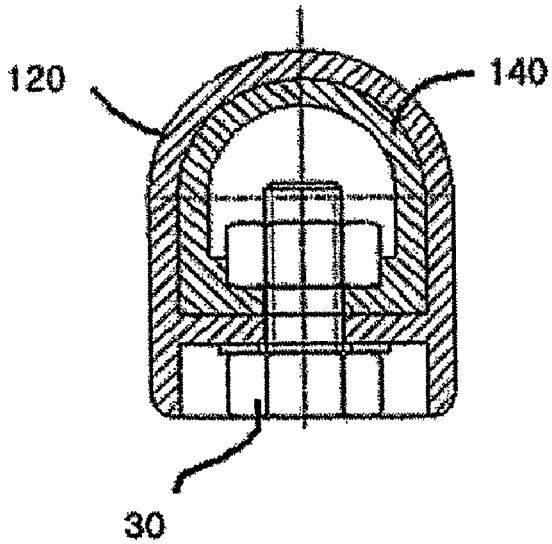

[Fig.9]
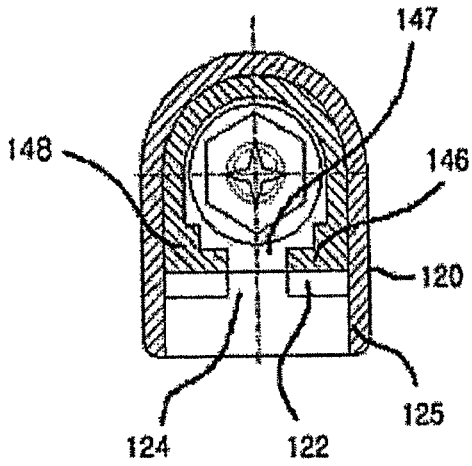
[Fig.10]
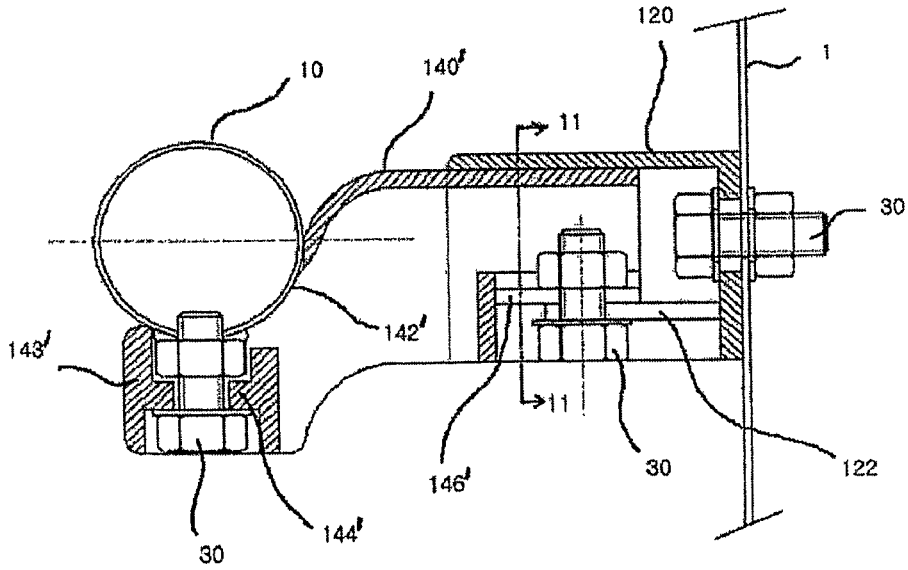

[Fig.11]
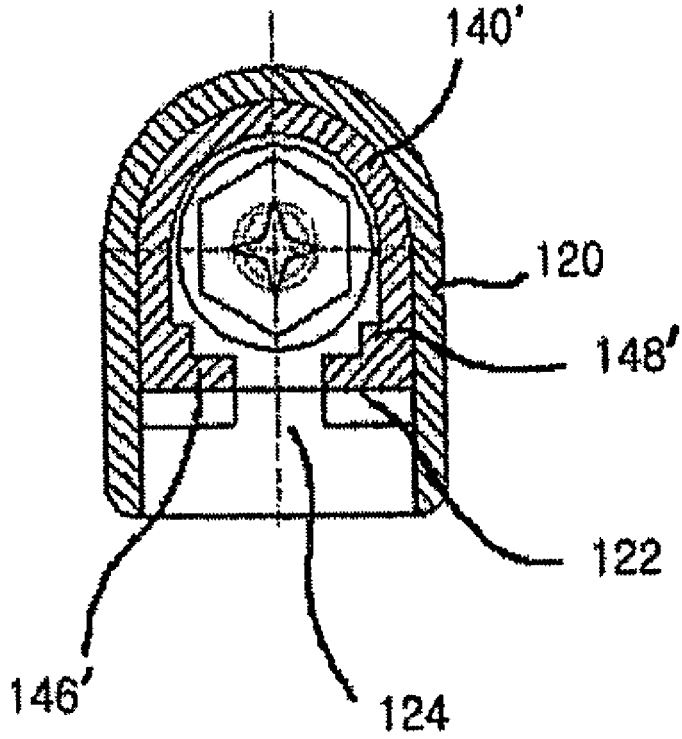

LENGTH ADJUSTABLE PASSENGER HANDLE ASSEMBLY FOR ELEVATOR

TECHNICAL FIELD

The present invention relates to a passenger handle assembly for an elevator, and more particularly, to a length-adjustable passenger handle assembly for an elevator, which can be easily installed into an elevator car while ensuring the safety of a serviceman, and can be adjusted in distance of a handle with respect to an inner wall of the elevator car.

BACKGROUND ART

Generally, conventional methods for installing a passenger handle to an inner wall of an elevator car can be divided into three types as follows.

FIG. 1 is a sectional view illustrating a typical elevator car, and illustrating a passenger, and a handle assembly.

As shown in FIG. 1, a cylindrical handle 10 is longitudinally attached to an inner wall of the elevator car at a suitable position to be gripped by a passenger. Generally, the handle 10 is held on the inner wall of the elevator car by brackets 20 separated a suitable distance from each other, and coupled thereto by fasteners 30 such as bolts and the like connected to the brackets.

FIG. 2 is an enlarged sectional view illustrating one example of conventional handle assemblies.

As shown in FIG. 2, each of the fasteners 30 such as bolts and the like is connected to one end of the bracket 20, and penetrates a wall 11 of the elevator car. The protruded fastener 30 is tightened by a washer or a nut at from the outside of the elevator car, and thus fixes the handle 10 to the wall of the elevator car. Such an assembling operation of the handle is generally performed after the decoration of the interior of the elevator car, and placement of the elevator car to the hoistway in a building. However, if the assembling operation of the handle is performed by an unskilled serviceman, there is a possibility of falling from the elevator car which is suspended in the hoistway, since it is necessary to perform the assembling operation outside the elevator car.

FIG. 3 is a sectional view illustrating another conventional handle assembly in an assembled state.

As shown in FIG. 3, the handle assembly further includes a C-shaped cap 25 enclosing a bracket. The cap 25 has a dimension to define a predetermined space therein in a state of being coupled to the bracket 20. Thus, a handle is assembled to an inner wall of an elevator car in such a way of coupling the cap 25 to the inner wall using a fastener 30 such as a bolt and the like inside the elevator car, followed by inserting the bracket into the cap 25, and fastening the bracket to the cap 25 using a small screw in a state wherein the bracket is inserted into the cap 25.

However, for this handle assembly, since the bracket is coupled to the cap by the small screw, engagement of the cap and the bracket loosens after a long period use, which finally causes the loose attachment of the handle to the inner wall of the elevator car. In addition, since the handle assembly generally includes several brackets (three or four brackets), there is a difficulty in alignment between the cap and holes for the fastener, which are previously formed in the wall of the elevator car.

FIG. 4 is a sectional view illustrating yet another conventional handle assembly in a disassembled state.

As shown in FIG. 4, a fastening plate 50 is welded to one end of a bracket 20, and then coupled to an inner wall of an elevator car by a fastener. In this handle assembly, since an assembling operation of the handle can be performed within the elevator car, it is possible to ensure the safety of the serviceman. However, since the fastening plate 50 extends out from both sides of the bracket 20, it is exposed outside the bracket, and in particular, the fastener comes into sight of the passenger. For an elevator car laying an emphasis on interior decoration, exposure of the fastening plate to the sight of the passenger becomes a serious problem. As a result, such a handle assembly has not been commonly applied to elevator cars placing an emphasis on interior decoration.

Considering the problems of the conventional handle assemblies, the applicant of the present invention has filed an application of a handle assembly for an elevator with improved workability as a utility model on Dec. 23, 2002.

FIG. 5 is a sectional view of the handle assembly of the applicant. In this handle assembly, a bolt 30 is screwed from an outer wall of an elevator car into the elevator car, and a handle is fixed to an inner wall of the elevator car by rotating a nut within the handle such that the nut is engaged with the bolt. However, since elevator cars are output from factories in a state wherein bolts are previously fixed to plates of the elevator car that act as the walls of the elevator car, so that, when stacking the plates, bolts protruding from one plate causes scars on another plate stacked thereon, thereby making it difficult to previously fix the bolt to the wall of the elevator. In addition, this handle assembly is inconvenient to fasten a washer and a nut to the bolt through the handle in practice.

Furthermore, since every conventional handle assembly described above employs the handle machined to have an opening instead of employing the handle as a cylindrical body itself available in the market without machining, additional machining costs, and material costs are required.

In order to solve this problem, the applicant of the present invention also filed an application of a handle assembly as shown in FIG. 6 as Utility Model Registration No. 9996 on Apr. 12, 2004.

This utility model was designed to solve the problem of the conventional handle assembly, and it is an object of this utility model to provide a passenger handle assembly for an elevator, which allows every operation to be performed within an elevator car without previously fixing a bolt to a wall of the elevator car in a factory, thereby ensuring the safety of the serviceman, prevents a fastener from being exposed to an outside of the bracket, thereby avoiding damage of the interior decoration of the elevator car, and provides secure engagement of the handle to the elevator car so as to keep the secure engagement of the handle for a long period of time, making maintenance of the assembly convenient.

As shown in FIG. 6, a plurality of external nuts 60 are attached to an outer wall 1 of the elevator car to be aligned with a plurality of through holes spaced a predetermined distance from each other on the outer wall of the elevator car, respectively. A first fastener such as a bolt and the like is connected to an associated external nut 60 through a through hole in a wall of a handle support 100 via a space in the handle support 100, and is tightened by a wrench to securely fix the handle support 100 to the wall of the elevator car.

With the passenger handle assembly as described above, every operation can be performed within the elevator car without previously fixing the bolt to the wall of the elevator car in the factory, thereby ensuring the safety of the serviceman, the fastener is prevented from being exposed to the outside of the bracket, thereby avoiding damage of the interior decoration of the elevator, the engagement of the handle to the elevator is firm, thereby keeping the engagement of the handle to the elevator car secure for a long period of time, which makes maintenance of the assembly convenient.

However, recently, the elevator car has a decoration plate attached inside thereof. Although the elevator may employ a thin decoration plate, a significantly thick decoration plate can also be employed. When a thick decoration plate is attached to an inner wall of the elevator car, there is a problem in that the distance between the cylindrical handle and an outer surface of the decoration plate is narrowed. In some cases, when a passenger grips the handle, it can be difficult to insert the hand into a gap between the handle and the decoration plate. Thus, it is necessary to adjust the length of the handle of the elevator car. Herein, the term 'length' means a distance between the handle and the inner wall of the elevator car.

DISCLOSURE OF INVENTION

Technical Problem

Therefore, the present invention has been made in view of the above problems, and it is an object of the present invention to provide a length-adjustable passenger handle assembly for an elevator, which can be adjusted in distance of a handle with respect to an inner wall of the elevator car, and enables convenient assembly and disassembly thereof within the elevator car.

Technical Solution

In accordance with an aspect of the present invention, the above and other objects can be accomplished by the provision of a passenger handle assembly for an elevator, including a handle having an elongated cylindrical shape to be gripped by a passenger, and being fixed to an inner wall of an elevator car by fasteners such as bolts, the handle assembly comprising: a plurality of substantially semi-cylindrical fixing members separated a predetermined distance from each other on the inner wall of the elevator car, each fixing member being fixed to the inner wall by at least one fastener while extending a predetermined distance from the inner wall, and including a first horizontal wall formed at a lower end of the fixing member and having an opening formed at an intermediate portion thereof along an entire length of the horizontal wall, the opening having a width preventing a head of the fastener from passing through the opening; and a plurality of substantially semi-cylindrical handle supports slidably fitted into the fixing members, respectively, and coupled at a leading end to the handle, each handle support including a vertical partition formed slightly inside the leading end of the handle support, and a second horizontal wall formed at a lower end of the handle support, the vertical partition defining a space with respect to the handle and having a through hole formed through the vertical partition to allow another fastener such as a cross-head bolt to penetrate the partition, the second horizontal wall having an opening formed at an intermediate portion thereof along an entire length of the second horizontal wall so as to correspond to the opening of the first horizontal wall, the opening of the second horizontal wall having a width preventing the head of the fastener from passing therethrough, wherein, with the handle securely fixed to the leading end of the handle support by the fastener, each handle support is inserted from a trailing end thereof to an inner space of an associated fixing member, adjusted to a desired distance with respect to the inner wall of the elevator car, and securely fixed to the fixing member by the fasteners through the openings of the first and second horizontal walls.

In accordance with another aspect of the present invention, a passenger handle assembly for an elevator, including a handle having an elongated cylindrical shape to be gripped by a passenger, and being fixed to an inner wall of an elevator car by fasteners such as bolts, the handle assembly comprising: a plurality of substantially semi-cylindrical fixing members separated a predetermined distance from each other on the inner wall of the elevator car, each fixing member being fixed to the inner wall by at least one fastener while extending a predetermined distance from the inner wall, and including a first horizontal wall formed at a lower end of the fixing member and having an opening formed at an intermediate portion thereof along an entire length of the horizontal wall, the opening having a width preventing a head of the fastener from passing through the opening; and a plurality of substantially semi-cylindrical handle supports slidably fitted into the fixing members, respectively, each handle support including an arc-shaped concave formed at one end of the handle support and having substantially the same shape as that of the handle so as to support the handle, a horizontal partition formed slightly below the concave to define a space with respect to the handle for placing a nut therein, and a second horizontal wall formed at a lower end of the handle support along a portion of an entire length of the handle support and having an opening formed at an intermediate portion so as to correspond to the opening of the first horizontal wall, the opening of the second horizontal wall having a width preventing the head of another fastener such as a bolt from passing therethrough, wherein, with the handle securely fixed to the concave of the handle support by the fastener, each handle support is inserted from a trailing end thereof to an inner space of an associated fixing member, adjusted to a desired distance with respect to the inner wall of the elevator car, and securely fixed to the fixing member by the fasteners through the openings of the first and second horizontal walls.

The second horizontal wall of the handle support may have steps formed at opposite sides on an upper surface of the second horizontal wall and spaced from each other to an extent that a separation between the steps prevents rotation of the nut tightening the fastener.

Each of the fixing members may have vertical walls extending from opposite ends of the second horizontal wall, each vertical wall having a length higher than a height of the head of the fastener such that, when the fastener is fastened to the fixing member, the head of the fastener is shielded by the vertical walls.

Advantageous Effects

As apparent from the above description, according to the present invention, even when a thin or thick decoration plate or a decoration plate with a grooved surface is attached to an inner surface of an elevator car, it is possible to adjust the distance between a handle and an inner wall of the elevator car corresponding to the thickness of a decoration plate, thereby enhancing the assembly efficiency of the handle assembly, and the convenience of a passenger.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sectional view illustrating a typical elevator car which has a conventional handle assembly;

FIG. 2 is a sectional view illustrating one example of conventional handle assemblies in an assembled state;

FIG. 3 is a sectional view illustrating another example of conventional handle assemblies in an assembled state;

FIG. 4 is a sectional view illustrating yet another example of conventional handle assemblies in a disassembled state;

FIG. 5 is a sectional view illustrating a conventional handle assembly of the applicant of the present invention;

FIG. 6 is a sectional view illustrating another conventional handle assembly of the applicant of the present invention;

FIG. 7 is a sectional view illustrating a handle assembly in accordance with a first embodiment of the present invention in an assembled state;

FIG. 8 is a cross-sectional view taken along line 8-8 of FIG. 7;

FIG. 9 is a cross-sectional view taken along line 9-9 of FIG. 7;

FIG. 10 is a sectional view illustrating a handle assembly in accordance with a second embodiment of the present invention in an assembled state; and FIG. 11 is a cross-sectional view taken along line 11-11 of FIG. 10.

BEST MODE FOR CARRYING OUT THE INVENTION

Preferred embodiments of the present invention will now be described in detail with reference to the drawings.

FIG. 7 is a sectional view illustrating a handle assembly in accordance with a first embodiment of the present invention in an assembled state, FIG. 8 is a cross-sectional view taken along line 8-8 of FIG. 7, and FIG. 9 is a cross-sectional view taken along line 9-9 of FIG. 7.

As shown in FIGS. 7 to 9, the handle assembly of the present invention comprises a cylindrical handle 10 to be gripped by a passenger, a plurality of handle supports 140 coupled to the handle 10 while being spaced a predetermined distance from the handle 10, and a plurality of fixing members 120 fixed to an inner wall of an elevator car by fasteners while receiving the handle supports 140, respectively.

The plurality of fixing members 120 are securely fixed to an inner wall 1 of the elevator car by the fasteners 30 such as bolts and nuts, and separated a predetermined distance from each other. Needless to say, the fixing members 120 and the handle supports 140 are provided as a pair, respectively, and thus correspond one to one. Each fixing member 120 preferably has a substantially semi-cylindrical cross-section. However, the present invention is not limited to this shape, and thus the fixing member 120 may have other cross-sections including a rectangular cross-section, a triangular cross-section, and the like. The fixing member 120 is formed at a lower end with a horizontal wall 122, which has an opening 124 formed at an intermediate portion thereof along the entire length of the horizontal wall 122. Since the opening 124 is provided to fix the fixing member 120 to the inner wall of the elevator car, as described below, by inserting the fastener such as the bolt therethrough, it is necessary to have a width which allows the column of the fastener 30 to pass through the opening 124 while preventing the head of the fastener 30 from passing therethrough. The length of the fixing member 120, i.e., an extending length of the fixing member 120 from the inner wall of the elevator car, can be suitably set corresponding to the size of the elevator car.

Basically, while being coupled to the handle 10, each of the handle supports 140 is fitted into an associated fixing member 120. At this time, the handle support 140 must be slidably fitted into the fixing member 120. In other words, it is necessary to allow a suitable length of the handle support 140 to move into or out of the fixing member 120 in a telescopic method.

For this purpose, the handle support 140 preferably has a substantially semi-cylindrical cross-section so as to be slidably fitted into the associated fixing member 120, but needless to say, it may have a cross-section corresponding to that of the fixing member 120. For example, if the fixing member 120 has any one of a rectangular cross-section, circular cross-section, a triangular cross-section and the like, the handle support 140 must have a cross-section corresponding to that of the fixing member 120.

Although a leading end 142 of the handle support 140 can be welded to the handle 10, it is desirable that the leading end 142 of the handle support 140 be coupled to the handle 10 by the fastener 30 such as a bolt. For this purpose, each handle support 140 has a vertical partition 144, which is provided slightly inward the leading end 142 to define a space 143 with respect to the handle 10, and has a through hole 145 formed through the vertical partition 144 to allow another fastener 30 such as a bolt to penetrate the partition 144. With such a construction, the handle support 140 can be securely fixed to the handle 10 using the bolt, as shown in the drawings.

The handle support 140 further includes a horizontal wall 146 formed at a lower end thereof. The horizontal wall 146 has an opening 147 formed at an intermediate portion thereof along the entire length of the horizontal wall 146 so as to correspond to the opening 124 of the fixing member 120. Similar to the opening 124 of the fixing member 120, the opening 147 of the handle support 140 must have a width which allows the column of the fastener 30 to pass therethrough while preventing the head of the fastener 30 from passing therethrough. In addition, the handle support 140 is preferably longer than the fixing member 120.

With the handle supports and the fixing members constructed as described above, the handle assembly of the present invention can be securely fixed to the inner wall of the elevator car in such a way that, with the handle 10 securely fixed to the leading end 142 of each handle support 140 by the fastener 30, each handle support 140 is inserted from a trailing end thereof to an inner space of an associated fixing member 120, adjusted to a desired distance with respect to the inner wall of the elevator car, and securely fixed to the fixing member 120 by the fastener 30 through the opening 124 of the fixing member 120 and the opening 147 of the handle support 140. Accordingly, when installing the handle assembly to the elevator car, the handle 10 can be fixed to the inner wall of the elevator car to have a desired distance with respect to the handle 10 by using the fastener 30 with consideration to the thickness of the decoration plate attached to the inner wall of the elevator.

Meanwhile, when fixing the handle supports 140 to the fixing members 120, respectively, it is general to fix the handle supports 140 to the fixing members 120 by way of inserting bolts and rotating them with respect to nuts. In this case, the assembling operation of the handle supports 140 to the fixing members 120 can be conveniently performed by placing the nut inside each handle support 140, and for this reason, it is desirable that the lower horizontal wall 146 of each handle support 140 have steps 148 formed at opposite sides thereof on an upper surface of the horizontal wall 146. The steps 148 are separated from each other to such an extent that the separation therebetween prevents rotation of the nut tightening the fastener 30. For example, in the case of hexagonal head nut, the distance between the steps 148 can be set corresponding to a distance between opposite faces of the hexagonal head of the nut.

In addition, for an aesthetic interior of the elevator, it is desirable that the fastener 30 described above not be exposed to the sight of the passenger if possible. For this purpose, each of the fixing members 120 has vertical walls 125 extending from opposite lower ends of the horizontal wall 122 such that each vertical wall 125 has a length higher than a height of the head of the fastener 30. As a result, when the fastener is fastened to the fixing member 120, the head of the fastener 30 is shielded by the vertical walls 125, and thus does not deteriorate the interior appearance of the elevator.

FIG. 10 shows a handle assembly of a second embodiment of the invention. FIG. 10 is a sectional view illustrating the handle assembly of the second embodiment, and FIG. 11 is a cross-sectional view taken along line 11-11 of FIG. 10.

The second embodiment is similar to the first embodiment in construction, except for the structure of handle supports 140'. According to the second embodiment, each of the handle supports 140' includes an arc-shaped concave formed at a leading end thereof to support a handle 10. In other words, the handle support 140 is slidably fitted into an associated fixing member 120, and has a substantially semi-cylindrical cross-section, in which one end of the handle support 140 is coupled to the handle 10, and is formed with an arc-shaped concave 142' having substantially the same shape as that of the handle so as to support the handle 10. In addition, the handle support 140' includes a horizontal partition 144' formed slightly below the concave 142' to define a space 143' with respect to the handle 10 for placing a nut therein, thereby allowing the handle 10 to be securely fastened to the concave 142' by a fastener. The handle support 140' further includes a horizontal wall 146' formed at a lower end thereof along a portion of the entire length of the handle support 140'. The horizontal wall 146' has an opening 147' formed at an intermediate portion so as to correspond to the opening 124 of the fixing member 124. Needless to say, the opening 147' has a width which prevents the head of the fastener 30 from passing therethrough. Since other constructions of the second embodiment are substantially the same as those of the first embodiment, detailed description thereof will be omitted hereinafter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A passenger handle assembly for an elevator, including a handle having an elongated cylindrical shape to be gripped by a passenger, and being fixed to an inner wall of the elevator car by fasteners such as bolts, the handle assembly comprising:

a plurality of substantially semi-cylindrical fixing members separated a pre-determined distance from each other on the inner wall of the elevator car, each fixing member being fixed to the inner wall by at least one fastener while extending a predetermined distance from the inner wall, and including a first horizontal wall formed at a lower end of the fixing member and having an opening formed at an intermediate portion thereof along an entire length of the horizontal wall, the opening having a width preventing a head of the fastener from passing through the opening; and a plurality of substantially semi-cylindrical handle supports slidably fitted into the fixing members, respectively, and coupled at a leading end to the handle, each handle support including a vertical partition formed slightly inside the leading end of the handle support, and a second horizontal wall formed at a lower end of the handle support, the vertical partition defining a space with respect to the handle and having a through hole formed through the vertical partition to allow another fastener such as a cross-head bolt to penetrate the partition, the second horizontal wall having an opening formed at an intermediate portion thereof along an entire length of the second horizontal wall so as to correspond to the opening of the first horizontal wall, the opening of the second horizontal wall having a width preventing the head of the fastener from passing therethrough, wherein, with the handle securely fixed to the leading end of the handle support by the fastener, each handle support is inserted from a trailing end thereof to an inner space of an associated fixing member, adjusted to a desired distance with respect to the inner wall of the elevator car, and securely fixed to the fixing member by the fasteners through the openings of the first and second horizontal walls.

2. A passenger handle assembly for an elevator, including a handle having an elongated cylindrical shape to be gripped by a passenger, and being fixed to an inner wall of the elevator car by fasteners such as bolts, the handle assembly comprising:

a plurality of substantially semi-cylindrical fixing members separated a pre-determined distance from each other on the inner wall of the elevator car, each fixing member being fixed to the inner wall by at least one fastener while extending a predetermined distance from the inner wall, and including a first horizontal wall formed at a lower end of the fixing member and having an opening formed at an intermediate portion thereof along an entire length of the horizontal wall, the opening having a width preventing a head of the fastener from passing through the opening; and a plurality of substantially semi-cylindrical handle supports slidably fitted into the fixing members, respectively, each handle support including an arc-shaped concave formed at one end of the handle support and having substantially the same shape as that of the handle so as to support the handle, a horizontal partition formed slightly below the concave to define a space with respect to the handle for placing a nut therein, and a second horizontal wall formed at a lower end of the handle support along a portion of an entire length of the handle support and having an opening formed at an intermediate portion so as to correspond to the opening of the first horizontal wall, the opening of the second horizontal wall having a width preventing the head of another fastener such as a bolt from passing therethrough, wherein, with the handle securely fixed to the concave of the handle support by the fastener, each handle support is inserted from a trailing end thereof to an inner space of an associated fixing member, adjusted to a desired distance with respect to the inner wall of the elevator car, and securely fixed to the fixing member by the fasteners through the openings of the first and second horizontal walls.

3. The passenger handle assembly according to claim 1 or 2, wherein the second horizontal wall of the handle support has steps formed at opposite sides on an upper surface of the second horizontal wall and spaced from each other to an extent that a separation between the steps prevents rotation of the nut tightening the fastener.

4. The passenger handle assembly according to claim 1 or 2, wherein each of the fixing members has vertical walls extending from opposite lower ends of the second horizontal wall, each vertical wall having a length higher than a height of the head of the fastener such that, when the fastener is fastened to the fixing member, the head of the fastener is shielded by the vertical walls.

* * * * *